US006467869B1

(12) United States Patent
Merz et al.

(10) Patent No.: US 6,467,869 B1
(45) Date of Patent: Oct. 22, 2002

(54) ECONOMICAL INK CARTRIDGE IDENTIFICATION

(75) Inventors: Eric A. Merz, Palmyra, NY (US); Richard E. Butts, Rochester, NY (US); Craig Tiller, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/905,224

(22) Filed: Jul. 13, 2001

(51) Int. Cl.[7] ..... B41J 29/393; B41J 2/17; B41J 2/175

(52) U.S. Cl. ..... 347/19; 347/84; 347/86

(58) Field of Search ..... 347/19, 84, 86, 347/44, 49, 7, 23, 14, 85

(56) References Cited

U.S. PATENT DOCUMENTS

| | | | | |
|---|---|---|---|---|
| 4,716,421 A | | 12/1987 | Ozawa et al. | 346/140 R |
| 5,049,898 A | | 9/1991 | Arthur et al. | 346/1.1 |
| 5,406,315 A | | 4/1995 | Allen et al. | 347/7 |
| 5,997,121 A | | 12/1999 | Altfather et al. | 347/7 |
| 6,084,607 A | * | 7/2000 | Matsuda | 347/19 |
| 6,097,405 A | | 8/2000 | Lo et al. | 347/6 |

FOREIGN PATENT DOCUMENTS

| | | |
|---|---|---|
| EP | 0 412 459 A2 | 2/1991 |

* cited by examiner

*Primary Examiner*—Raquel Yvette Gordon
*Assistant Examiner*—Charles W. Stewart, Jr.
(74) *Attorney, Agent, or Firm*—David J. Arthur

(57) ABSTRACT

A printer determines the characteristics of the ink of the replaceble ink cartridge by set of ink cartridges. Each ink cartridge is formed of a housing and includes marks on the exterior surface of the housing. The marks on the cartridge housing are arranged so that the marks on the several ink cartridges collectively form a pattern of marks. The printer electronically scans the pattern of marks, and automatically produces an indication in accordance with the pattern of marks to identify the brand and/or type of ink contained in the set of cartridges, the ink capacity of the cartridges, as well as to verify that an appropriate combination of cartridges has been installed. Printer performance characteristics, such as expected print yield, can be determined based on the indication produced by scanning the pattern of marks.

19 Claims, 7 Drawing Sheets

ECONOMICAL INK CARTRIDGE IDENTIFICATION

BACKGROUND OF THE INVENTION

The present invention generally relates to printers for printing a multi-color ink image onto a print medium, such as paper. In particular, the invention relates to identifying characteristics of the ink cartridges installed in such a printer to permit appropriate printer management.

The background and specific implementations of the present invention will be described in connection with a thermal ink jet printer that uses liquid ink. One example of thermal ink jet printing is described in U.S. Pat. No. 5,997,121. However, after reading the following description, those familiar with the art will recognize that the invention is applicable to printers of different types, such as piezoelectric printers that use either liquid or solid ink, acoustic ink jet printers, and others. These different types of printing technologies are well understood in the art.

Generally, in ink jet printing, a printhead forms and then ejects a droplet of ink toward the print medium, which may be paper, vinyl, a transparency, or other material. The printhead draws ink from an ink container that is connected to the printhead. Typically, the ink container is replaceable so that after the ink supply contained in the container is exhausted, the user replaces the container. In certain printers, the ink container and the printhead are manufactured, sold, installed, and replaced as a single integrated unit. In other implementations, the printhead and the ink container are separate, so that the ink container is replaced without simultaneously replacing the printhead.

Printer users may install into the printer ink containers containing different types of inks. For example, a user who is printing photographs may use different types of inks than a user printing text documents, such as letters or reports. Some inks use dyes for color while others use pigments for color. Some inks are aqueous (water based), while others use oil or other carriers. In addition, many printers monitor the amount of ink used, so that the printer can notify the user when the ink supply in a particular ink container is nearly exhausted. For the printer to perform this function, it is useful for the printer to know upon installation of an ink container the capacity of that ink container. In addition, the printer may have the capability of adjusting the printer characteristics depending on the type of ink installed, to optimize the print quality and ink usage. Finally, certain printers may not perform optimally with certain brands or types of inks, and therefore the user should be warned, or the printer disabled, if an inappropriate ink is installed in the printer.

For the above reasons, it is useful for a printer to be able to identify certain information pertaining to the ink contained in the ink containers installed in the printer.

SUMMARY OF THE INVENTION

In accordance with an aspect of the present invention, the method of determining ink characteristics includes installing in a printer a plurality of ink cartridges. Each of the ink cartridges comprises a housing, and includes marks on an exterior surface of the housing. The marks on each cartridge housing are arranged so that the marks on the plurality of ink cartridges collectively form a pattern of marks. The method further includes electronically scanning the pattern of marks, and automatically producing an indication in accordance with the pattern of marks.

In accordance with another aspect of the present invention, a set of ink cartridges for a printer includes a plurality of ink cartridges, each of which comprises a housing enclosing an interior space, and marks on an exterior surface of the housing. The marks on the housing of the ink cartridges are arranged so that the ink cartridges are properly installed in the printer, the marks collectively form a predetermined pattern of marks.

In accordance with yet another aspect of the present invention, a printer for printing a multi-color ink image onto a print medium includes a media support for supporting a print medium in a print position, and a printhead for dispensing ink onto the print media supported in the print position. An ink supply system is connected to the printhead for supplying ink to the printhead. The ink supply system includes a plurality of ink cartridges, each of which comprises a housing enclosing an interior space, and has marks on an exterior surface of the housing. The marks on the housing of the ink cartridges are arranged so that when the cartridges are properly installed in the ink supply system, the marks form a pattern of marks. A sensor connected to the frame is positioned to scan the marks on the cartridges installed in the ink supply system. A controller is connected to the printhead for controlling the operation of the printhead, and is also connected to the sensor for receiving data about the pattern of marks. The controller is programmed so if the data about the pattern of marks indicates that the pattern of marks is a first predetermined pattern, the controller establishes first printing parameters for the printhead, and if the data concerning the pattern of marks indicates that the pattern of marks is a second predetermined pattern, the controller establishes second parameters for the printhead.

DETAILED DESCRIPTION

Figure 1:
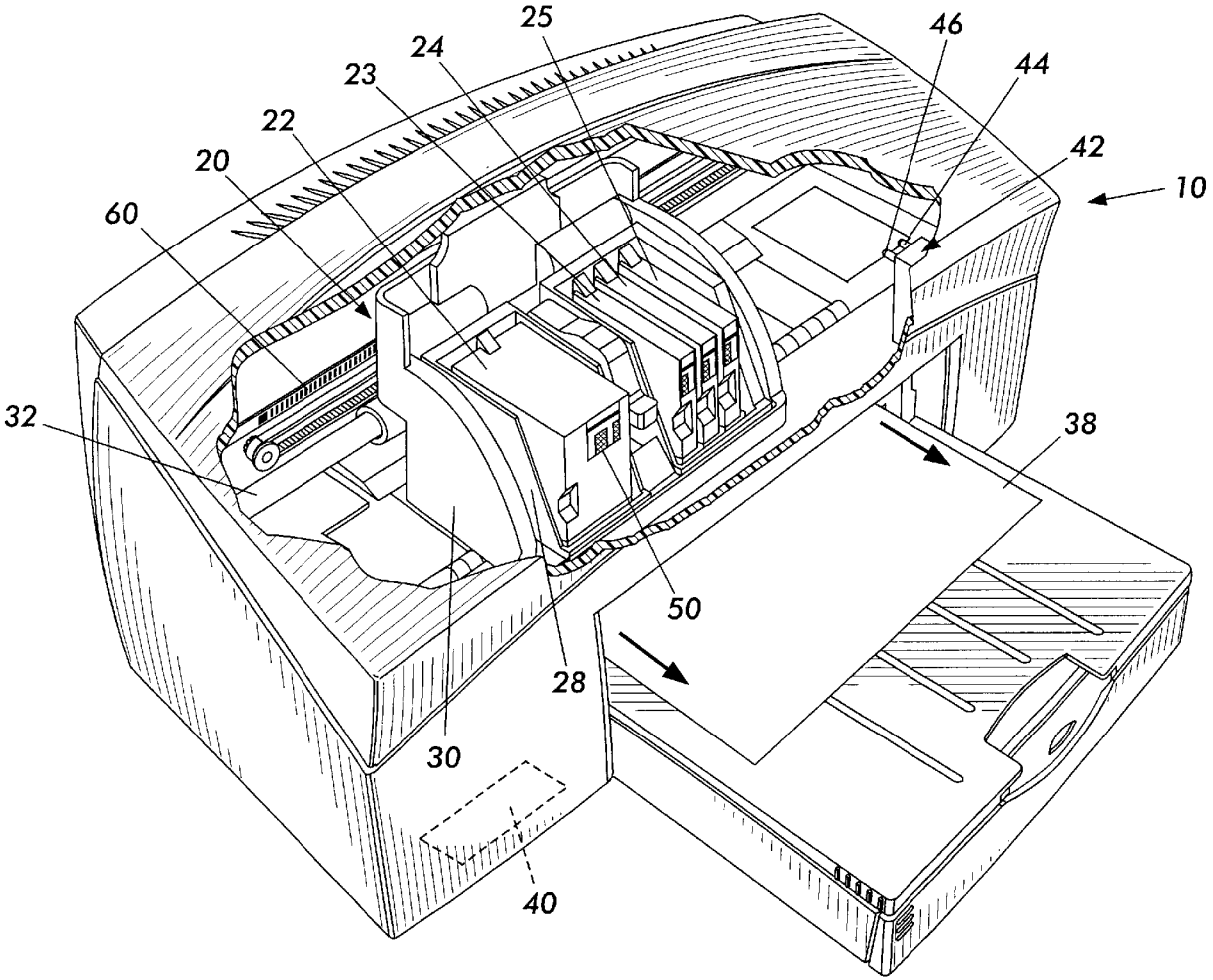
FIG. 1 is a perspective view, partially cut away, of a printer incorporating an implementation of an ink cartridge identification system.

Referring to FIG. 1, a multi-color printing apparatus or printer 10, includes an ink supply system 20 that incorporates a printhead cartridge assembly with several ink cartridges 22, 23, 24, 25. The illustrated embodiment includes four ink cartridges in a cartridge support structure 28. The cartridge support structure 28 of the printhead cartridge assembly is mounted on a carriage 30 that is supported by a carriage rail 32. The carriage rail in turn is supported by a frame of the printer.

As those familiar with the ink jet printing arts will recognize, each ink cartridge includes a replaceable ink container or ink tank. For a printer employing liquid ink, such as a thermal ink jet printer, the ink container is formed of a housing enclosing an interior space, with the liquid ink contained within the interior space of the housing. Although a particular implementation is described in use in a thermal ink jet printer, those familiar with the printing arts, after reading the present description, will recognize that the invention can be practiced in other types of multi-color printers, such as piezoelectric or acoustic printers. Such other printers may use liquid, solid, or semi-solid ink. Therefore, the exact configuration of the ink container for such printers may differ from the embodiment shown.

As those familiar with the ink jet arts, and the thermal ink jet arts in particular, will recognize, the printhead for each ink cartridge may in some implementations be integrally formed with the ink cartridge, while in others the printhead may be separate from the ink cartridge. If the printhead is separate from the ink cartridge, the printhead may be permanently affixed to the cartridge support structure 28 on the carriage.

The particular implementation illustrated includes four replaceable ink cartridges 22, 23, 24, 25, each of a different color. One cartridge 22 is black, one cartridge 23 is magenta, one cartridge 24 is yellow, and one cartridge 25 is cyan. The black ink cartridge 22 in this implementation is larger than the cartridges for the other colors, so that it can hold a larger quality of ink, as most users use more black ink than other ink colors. Other color combinations may be included in different types of printers. For example, in addition to the magenta, yellow, and cyan cartridges, the cartridge support structure may also hold a light magenta cartridge, a light cyan cartridge, and a "photo black" cartridge.

Figure 2A:
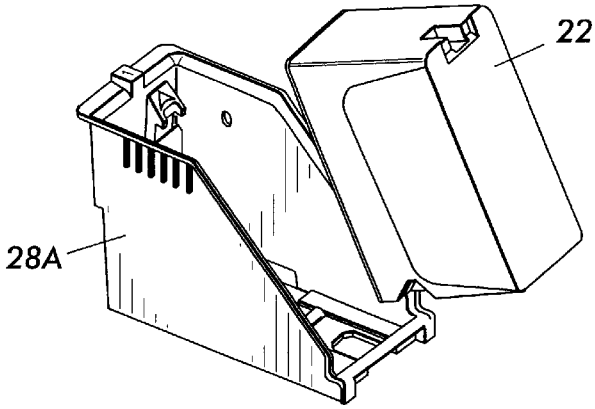
FIGS. 2A through 2C illustrate the installation of an ink cartridge in a cartridge mounting structure incorporated in the printer of FIG. 1.
Figure 2B:
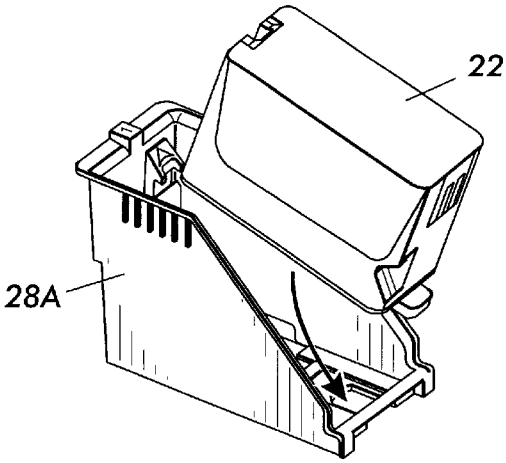
Figure 2C:
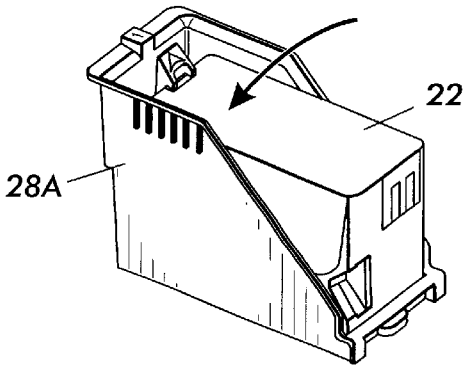
Figure 3:
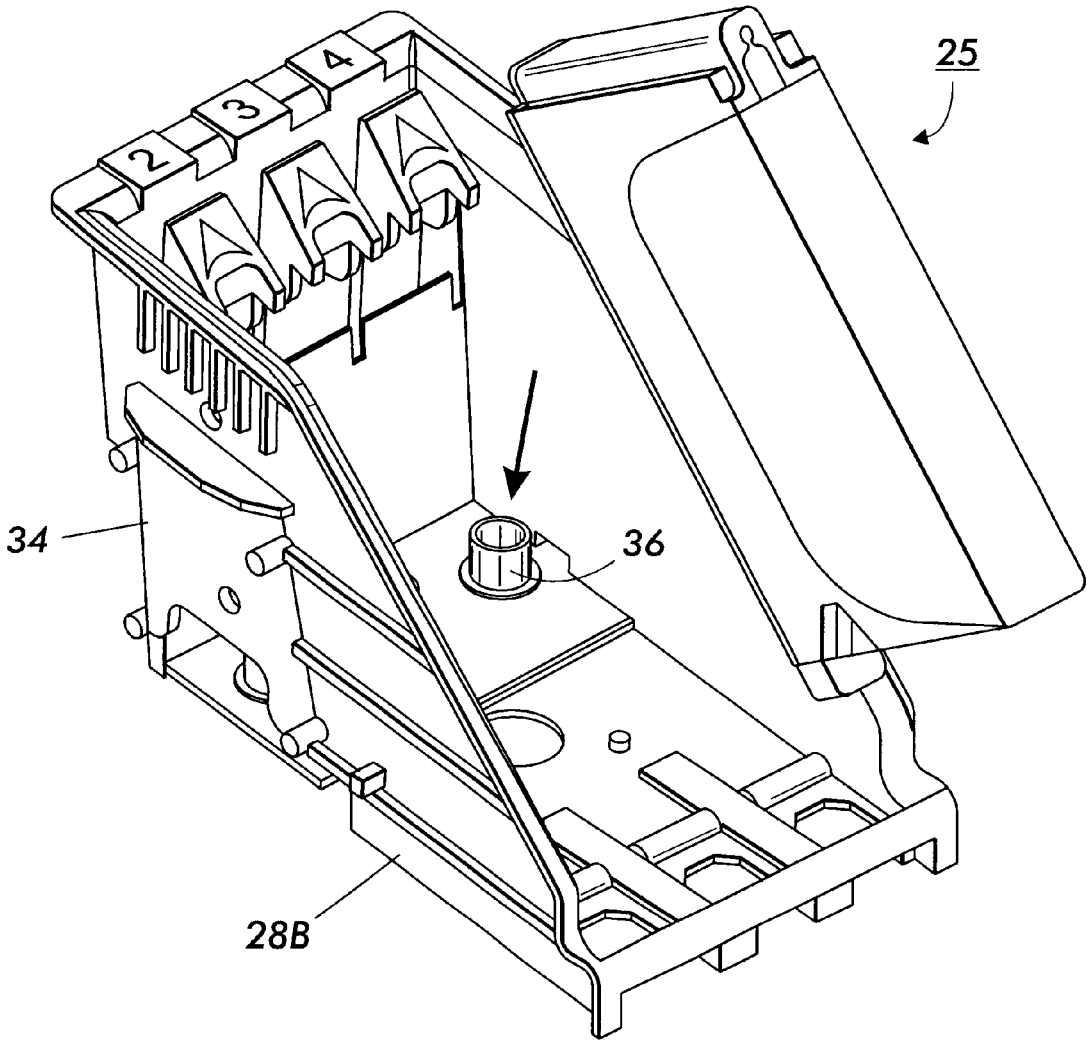
FIG. 3 illustrates the installation of a cartridge in a different portion of the cartridge mounting structure of the printer of FIG. 1.
Figure 4A:
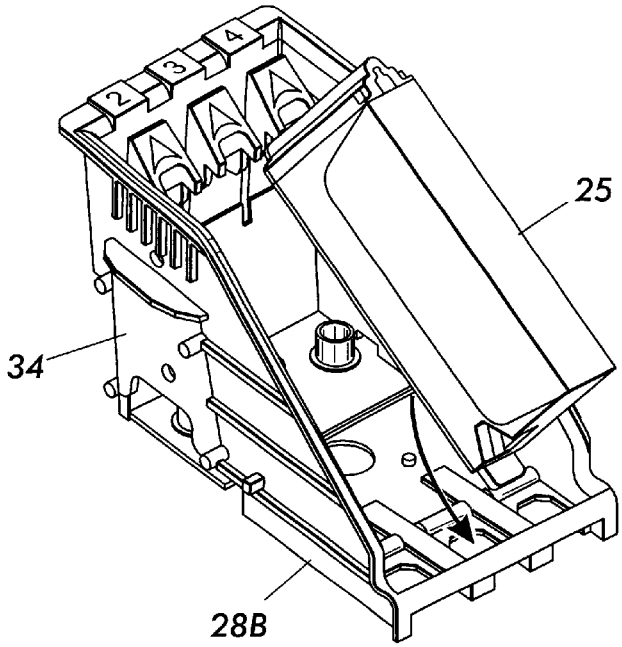
FIGS. 4A and 4B illustrate additional details of installation of the cartridge shown in FIG. 3.
Figure 4B:
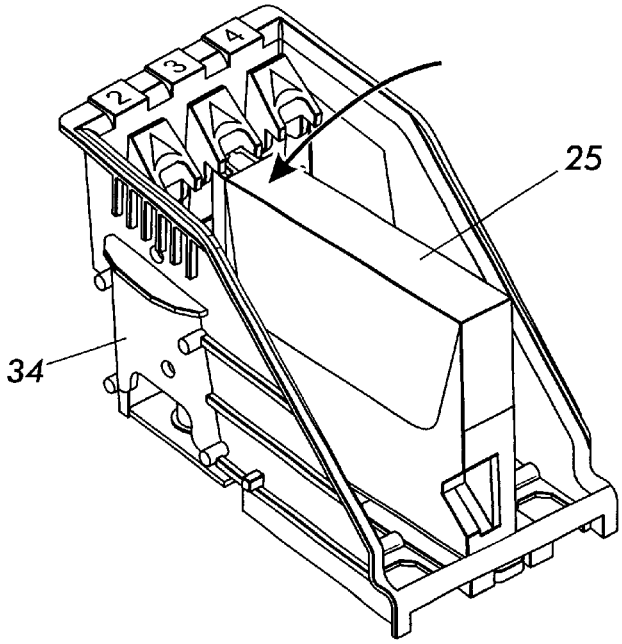

In the particular implementation illustrated, the black ink cartridge 22 is installed on a first portion of the cartridge support structure 28A, and the magenta, yellow, and cyan ink cartridges 23, 24, 25 are installed on a second portion of the cartridge support structure 28B. FIGS. 2A, 2B, and 2C show the installation of the black ink cartridge 22 onto the first portion of the cartridge support structure 28A. This installation is described more completely in U.S. application Ser. No. 09/597,550, entitled "Fail-Safe Ink Tank Latching System", naming inventors Edward M. Carrese et al., and assigned to the same assignee as the present application. The contents of that application are hereby incorporated by reference. FIG. 3 shows the installation of the cyan color cartridge 25 into the second portion of the cartridge support structure 28*b*. In the illustrated configuration, the second portion of the cartridge support structure has three slots to receive ink cartridge. The cyan cartridge 25 is installed in the third slot. The installation aof the magenta and yellow cartridges 23, 24 is substantially identical to the installation of the cyan cartridge, except that the magenta and yellow cartridges installed in the first and second slots. FIGS. 4A and 4B show the installation of the yellow cartridge 24 in the second slot of the second portion of the cartridge support structure 28B.

As noted above, the ink cartridge of the particular implementation illustrated is separate from the printhead, and the printhead is permanently affixed to the cartridge support structure 28. The ink supply system 20 of the illustrated implementation contains two printheads (not shown). One printhead is mounted on the first portion of the cartridge support structure 28A, and dispenses ink from the black ink cartridge 22. A second printhead is mounted on the second portion of the cartridge support structure 28B, and dispenses ink from the color ink cartridges 23, 24, 25. Referring now to the second portion of the cartridge support structure shown in FIGS. 3 and 4, the cartridge support structure includes on one side thereof a printhead mounting element 34 that receives a printhead (not shown). The printhead includes a plurality of ink nozzles arranged in a pattern at the end of the printhead. The printhead draws ink from the ink container 25 through a manifold and capillary tube (not shown) in the printhead and the support structure 28B. The support structure includes a manifold mounting pipe 36 for each ink cartridge to be mounted on the cartridge support structure. The manifold mounting pipe 36 connects with an outlet port (not shown) of the ink container 25 to supply ink from the replaceable ink container to the printhead. The manifold and capillary tubes in the multiple tank support structure 28B direct ink from each separate ink container to a different segment of the printhead. Thus, the nozzles of different segments of the printhead of the multiple container support structure are each associated with a particular one of the ink containers. The single color ink container support structure 28A shown in FIG. 2 includes a single manifold mounting pipe to connect with a single outlet port of the black ink cartridge 22.

Referring again to FIG. 1, when the printer 10 is printing, the carriage 30 with the cartridge support structure 28 reciprocates back and forth along the carriage rails 32. A media support, such as a platen (not shown), is attached to the printer frame for supporting a print media 38 in a print position adjacent the path of the printheads as the carriage 30 reciprocates along the carriage rail. As the carriage moves across the media, a printer system controller directs 40 each printhead to expel appropriate droplets of ink from selected ones of the nozzles in each printhead toward the medium that is supported by the platen. When the printer is idle, or not printing, the entire printhead cartridge assembly 30 with the ink delivery system 20 is moved to one side of the printer, such as to the right side of the printer as shown in FIG. 1. The printer may include a maintenance station at the point which the printhead carriage assembly rests while the printer is idle. The maintenance station includes devices for cleaning the printheads, and performing certain other maintenance tasks.

Adjacent the maintenance station is an ink cartridge brand and type sensor 42. The ink cartridge brand and type sensor includes a source of radiation 44, such as an infrared emitter, and a detector 46, such as an infrared emission detector or a photo transistor detector. The detector 46 detects radiation reflected off the outer surface of one side of each ink cartridge 22, 23, 24, 25, mounted on the printhead carriage assembly 30 as the printhead carriage assembly moves past the sensor 42. The radiation reflected originates with the radiation source 44, which may be part of the ink cartridge brand and type sensor assembly, or may be separate from the assembly. The radiation source 44 may emit light from the visible spectrum, the infra red spectrum, or the ultraviolet spectrum. The detector 46 is of a type to detect radiation in the same frequency range as the radiation produced by the radiation source.

Figure 5:
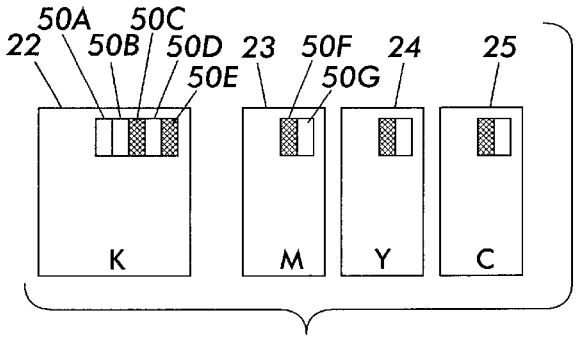
FIG. 5 schematically illustrates a pattern of marks formed by the installation of ink cartridges into the printer of FIG. 1.

Each ink cartridge 22, 23, 24, 25 has one or more marks 50 that can be detected by the detector as the ink cartridge moves past the detector 46. FIG. 5 shows stylistically the ends of the ink cartridges as "seen" by the detector 46. Each ink cartridge has marks applied to an exterior surface of the cartridge housing. Collectively, the marks on the plurality of ink cartridges contained on the printhead cartridge assembly carriage form a pattern of marks that can be detected by the detector as the carriage 30 moves past the ink tank cartridge brand and type sensor 42 at a substantially uniform rate of motion. Information gathered by the detector from the scan of the pattern of marks on the plural tanks or cartridges is conveyed to the printer controller 40. The printer controller 40 analyses the information detected by the scanner, and performs certain predetermined functions based on the information obtained.

For example, the collective pattern of marks formed by the marks on the individual cartridges conveys to the printer controller information concerning the brand of ink tanks or cartridges, the type of ink contained in the ink cartridges, and the quantity of ink in the ink cartridges. In the particular implementation illustrated in FIG. 5, the black cartridge has five marks, one of which 50A is a reference mark beginning the pattern of marks, and the other four of which 50B, 50C, 50D, 50E are datum marks that convey information about the ink cartridge. On the illustrated cartridge, the reference mark 50A is white, the two datum marks 50B, 50C, 50D, 50E are white, black, respectively. Each of the additional cartridges has two datum marks 50F, 50G. Thus, the collective pattern contains 10 datum marks that can be sensed by the detector and used to identify information concerning the set of ink cartridges.

The marks as illustrated are designed to be red by the sensor as the carriage moves from right to left. Thus, the first mark that the sensor detects is the reference mark 50A on the black cartridge. Once the detector 46 detects the reference mark on the black cartridge, the controller 40 can determine where the datum marks 50B, 50C, 50D, 50E, 50F, 50G for the black cartridge and for the color cartridges are to be. The field of view, or window, of the detector is wide enough to ensure that within the predetermined period of time, the reference mark on the black container is entirely within the field of view of the sensor.

A carriage position sensor provides the printer controller with an exact position of the carriage with respect to the frame. With this information, the printer controller can determine an approximate time frame in which the reference mark on the black ink cartridge should appear in the field of view of the sensor. The carriage position sensor may include an encoder film strip 60 fixedly mounted on the printer frame. The encoder film strip 60 is marked with position marks. As the carriage 30 moves, the encoder film passes by a carriage position detector on the backside of the carriage. When a predetermined mark, corresponding to a particular position of a carriage with respect to the printer frame passes the detector, the printer controller can determine the position of the carriage with respect to the frame. With this information, the printer controller can then determine the approximate time at which the reference mark 50*a* of the black ink cartridge should pass the detector 46 of the ink cartridge brand and type sensor 42. For example, the controller 40 can count a predetermined number of clock pulses after the position detector window senses the predetermined mark on the encoder film 60. For particular accuracy, the encoder film 60 may physically contact the detector carriage position detector as it passes by. Other methods of detecting the position of the carriage, including magnetic or optical or physical contact, may also be used to identify for the printer controller the exact position of the carriage 30 relative to the printer frame.

The printer also determines the presence of ink tanks or cartridges in the cartridge support structure through the use of an ink tank presence sensor, such as is described in U.S. Pat. No. 5,997,121, SENSING SYSTEM FOR DETECTING PRESENCE OF AN INK CONTAINER AND LEVEL OF INK THEREIN by Alffather et al., the contents of which are hereby incorporated by reference. Detecting the presence of the ink tank container through such a system allows the printer controller 40 to identify a referenced position at which the sensor should be able to detect the datum marks on the color ink cartridges. To account for potential tolerance variation, the datum marks 50F, 50G on the color tanks 23, 24, 25 may be slightly wider than the datum marks 50B, 50C, 50D, 50E on the black tank. For example, the datum marks on the black tank may each be approximately 3 millimeters in width, while the datum marks on the color tanks may be 4 millimeters in width. This improves the likelihood that the detector 46 of the ink cartridge brand and type sensor 42 will detect the datum marks on the color tanks.

Referring again to FIG. 1, the detector senses the pattern of marks as the printhead carriage assembly moves from right to left, as it leaves the maintenance station in the printer. Thus, the reference mark on the black ink cartridge 22 passes the detector 46 first, followed by the datum marks on the black cartridge 22, and then the datum marks on the magenta, yellow, and cyan cartridges 23, 24, 25.

Figure 6A:
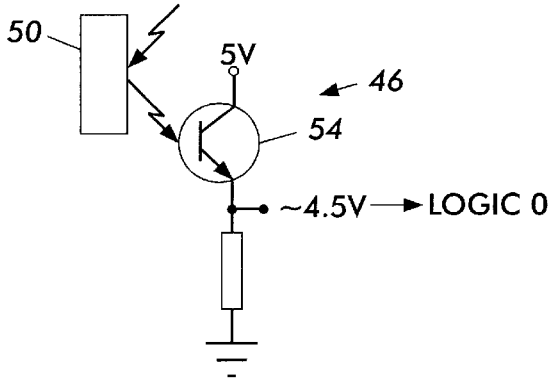
FIGS. 6A and 6B illustrate the response of a mark detector element used for ink cartridge identification.
Figure 6B:
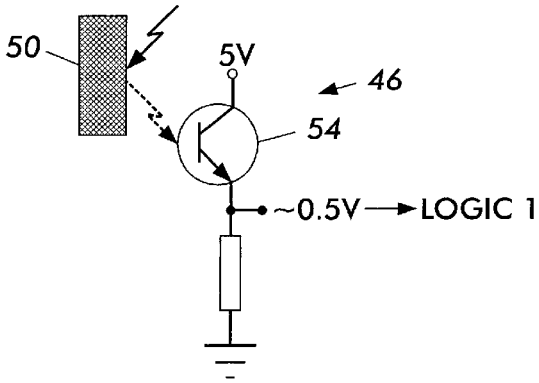

Referring next to FIG. 6A, a schematic diagram of a photosensor appropriate to use as the detector 46 is shown. The detector 46 produces a logic zero when a relatively greater amount of light impacts the detector 46, such as would occur when the light is reflected off of a white mark. In the particular implementation shown, the relatively greater amount of light impacts a phototransistor 54 rendering the phototransistor relatively conductive, so that most of the voltage at the voltage source appears at the output terminal. The printer controller interprets this relatively high voltage as a logic 0. Referring next to FIG. 6B, the detector produces a logic 1 when a relatively smaller amount of light is reflected onto the photodetector, such as would occur when the light is reflected off of a black mark. As shown, the relatively lesser amount of light impacts the phototransistor and the phototransistor 54 remains relatively nonconductive, so that little of the voltage at the voltage source appears at the output terminal. The printer controller interprets this relatively low voltage as a logic 1. Other types of sensors, and photosensors in particular can be used to detect the different marks on the cartridge. In addition, the controller can be programmed to identify other output patterns from the photodetector. For example, the controller can be programmed to recognize the dark mark as a logic 0 and the white mark as a logic 1.

The datum marks 50B, 50C, 50D, 50E, 50F, 50G are typically large and of highly contrasting colors, so that they may be detected by inexpensive detectors. The marks may be printed on labels that are attached to the cartridge 22, 23, 24, 25 with an appropriate adhesive.

As the printhead cartridge assembly containing the exemplary set of ink cartridges shown in FIG. 5 moves past the detector 46, the detector produces, from the ten datum marks on the set of ink cartridges, the following bit pattern: 0101101010. The printer controller interprets this data to produce an indication or a signal corresponding to the pattern of marks that produced the data pattern. The printer controller, in response to the indication, can adjust or alter printer characteristics depending on the indication produced. For example, the collective pattern of marks may indicate the brand of ink contained in the ink cartridges. In addition, the pattern may identify the type of ink contained in the ink cartridge. For example, the pattern may indicate whether the cartridge contains standard ink, or a particular type of ink for a special application, such as printing photographs. The pattern of marks may also indicate the ink capacity of the cartridges. From the expected yield information, the controller can then track ink usage, such as by counting ink droplets expelled through the printhead, to estimate when the ink cartridge is about to run out of ink. Such estimation allows the printer to be stopped before the cartridge actually runs out of ink, thereby reducing the possibility of damage to the printhead, and allowing the user to replace the cartridge so that no printing is lost due to the lack of ink in the print ink cartridge.

Figure 7:
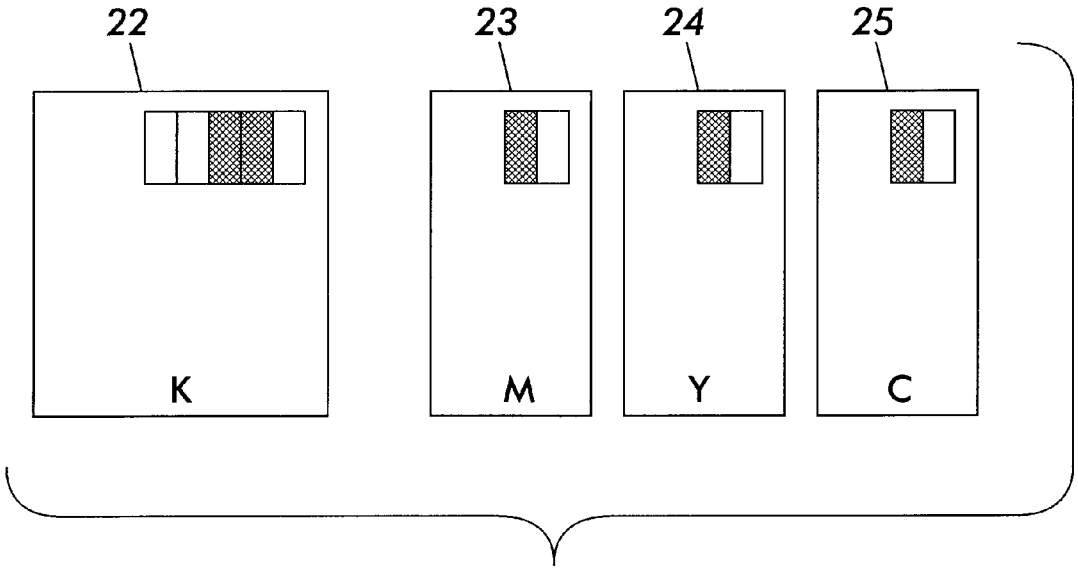
FIG. 7 schematically illustrates a different pattern of marks formed by the installation of a different set of ink cartridges into the printer of FIG. 1.

The printer controller 40 is configured to compare the data from the detected pattern of marks with any number of stored patterns that are predetermined in association with particular cartridge characteristics. For example, the predetermined patterns can be established in which particular values and particular locations indicate the cartridges of a particular brand, while other values in other locations indicate the capacity of the cartridge, and the ink type. For example, the pattern of marks shown in FIG. 5 (0101101010) may indicate a set of cartridges from manufacturer A, which cartridges are high capacity cartridges containing a general purpose ink. In contrast, the pattern shown in FIG. 7 (0110101010) may indicate that the cartridges are still from Brand A, and of high capacity, but that they contain a special type of ink, such as for producing photographic prints. By using a pattern of marks, rather than relying on specific marks on individual cartridges, a larger number of possible patterns are provided to permit the controller to discriminate among a larger set of possible configurations.

The controller can be further configured so that if the sensor detects a particular pattern of marks, or identifies a pattern of marks that does not match any of the predetermined patterns stored in the printer, the printer controller produces an error message or other predetermined message to the user indicating that the ink cartridge set does not match. Such a nonmatch may occur, for example, if one of the cartridges is missing, or not installed properly so that the sensor does not detect the marks on a particular or at a particular location in the cartridge set. In addition, if the printer is of a type that requires a particular type of ink, the controller can use the information from the pattern of marks to display a message to the user if a set of cartridges with an inappropriate type of ink is installed.

The controller can also be configured to identify particular bits in the pattern of bits produced by the pattern of marks as detected by the detector for particular information. For example, the controller for one particular purpose could look at the pattern of a subset of the marks on the cartridges, and either ignore the other marks, or declare them as (don't care) marks. For example, the controller can be set up to recognize that the third and fourth datum marks on the black cartridge, plus the first datum mark on each of the color cartridges identifies the manufacturer of the cartridge set. Thus, for example, the controller can identify a cartridge set that produces a data pattern XX011X1X1X as identifying a set of cartridges from manufacturer or brand A, while a pattern XX100X0X0X identifies the cartridges of brand B, and the pattern XX111X1X1X identifies cartridges of brand C (in all of which, the X indicates a data bit that the controller either ignores or designates as a "don't care" data bit).

In each of the examples given immediately above, the mark on each of the color cartridges 23, 24, 25 that becomes part of the brand identifying patter is the same. In the examples for brands A and C above, the first datum mark 50F for each color cartridge is black. Howwever, the patterns can be arranged so that the marks on the cartridges that become part of the brand identifying pattern can be different. For example, a cartridge set of brand D may be identified by a pattern XX111X0X1X. In that case, the first datum mark 50F of the magenta and cyan cartridges 23, 25 are black, but the first datum mark 50F of the yellow cartridge 24 is white.

Either in the same operation, or in a separate operation, the controller can be programmed to recognize a different subset of the data bit to identify another characteristic of the cartridge, such as, for example, whether the cartridges are of a high capacity or low capacity, or whether the cartridges contain a dye based ink, or a pigment based ink, or whether the cartridges contain an ink appropriate for producing photographs, or ink appropriate for general purpose printing. For example, the first data bit from the black cartridge, and the second data bit from each of the magenta, yellow, and cyan cartridges may provide the capacity of the cartridge. The processor may even be programmed so that this information is read individually for each cartridge, so that the printer can accommodate cartridges of different capacities. Conventionally, printer performance is not affected by having cartridges of different capacities loaded at the same time.

The printer controller may review or scan the pattern of marks when the printer detects that one or more ink cartridges has been replaced. A typical indication that one or more of the ink tanks has been replaced is if the ink level sensor that detects whether the quantity of ink in a particular cartridge is below a predetermined threshhold determines that a low ink condition exists, and then on a subsequent check, determines that the ink level is no longer in a low ink situation, the printer concludes that the ink cartridge has been replaced. On replacement of one or more of the ink cartridges, the printer controller 40 determines that it should check the pattern of marks on the cartridges. In addition, a controller may permit manual instructions to check the information on the cartridges.

Figure 8:
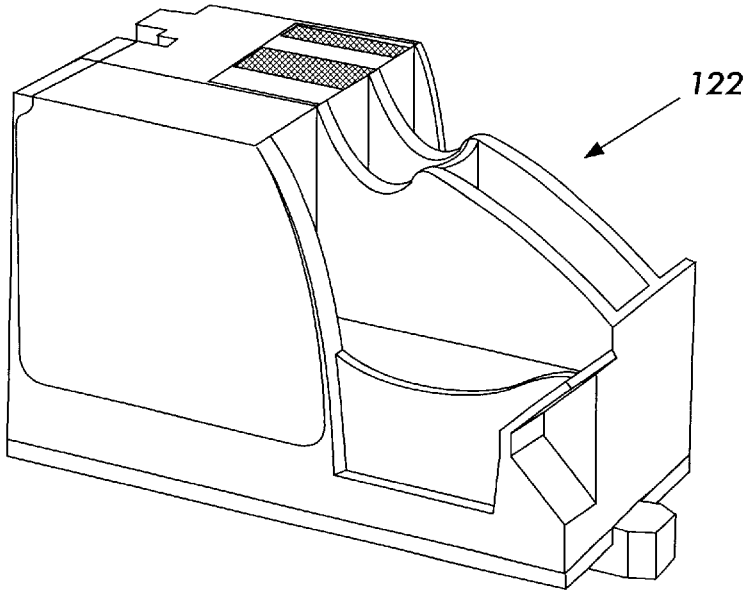
FIG. 8 illustrates an alternative implementation of an ink cartridge for use with an aspect of the present invention.
Figure 9:
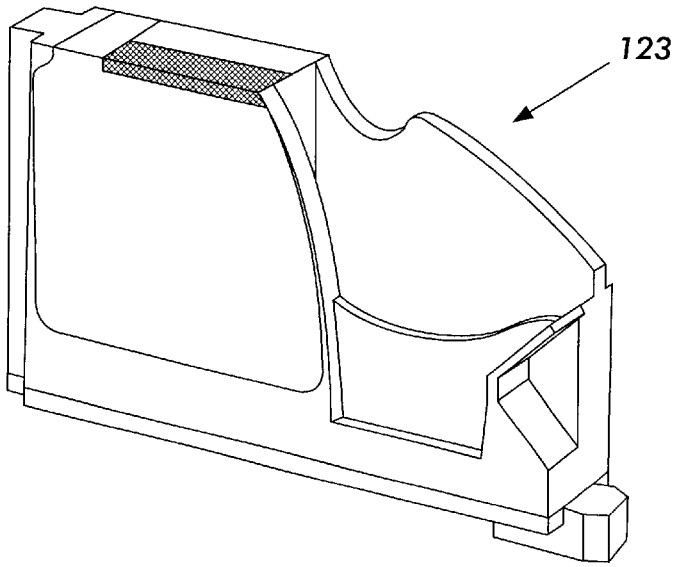
FIG. 9 illustrates yet another implementation of an ink cartridge for use with the present invention.

FIGS. 8 and 9 illustrate alternative implementations of ink cartridges 122, 123 incorporating an aspect of the present invention. A feature of the illustrated cartridges is that the marks on each tank are on the top surface of the cartridge. Using cartridges of this configuration, the printer uses a detector or scanner mounted above the path of the printhead assembly, so that the scanner detects the marks on the top surface of the cartridges. Those skilled in the art will recognize that the marks can also be placed on the top surface of the more rectangular cartridge as shown in FIGS. 2, 3, and 4. The placement of the marks on the cartridge is often determined by the geometry of the interior of the printer, which determines the optimum placement of the scanner.

While the present invention has been described in connection with particular embodiments thereof, those skilled in the art will recognize that various alternatives and modifications can be implemented without departing from the scope of the invention. For example, different shapes of ink cartridges can be used, and the marks can be placed at different locations in the ink cartridge, depending on the geometry of the printer and the placement of the scanner. In addition, various patterns of marks can be used to identify different characteristics of the set of ink cartridges. Furthermore, different numbers of ink cartridges can be used to form the pattern, as well as different numbers of marks on each tank. Yet further, the invention can be implemented on ink cartridges that incorporate an integrated printhead, or a separate ink tank and printhead. In addition, the invention can be used in other replaceable components of the printer.

We claim:

1. A method of determining printer ink characteristics, the method comprising:

installing in a printer a plurality of ink cartridges, wherein each of the ink cartridges comprises a housing, and includes marks on an exterior surface of the housing, wherein the marks on each cartridge housing are arranged so that the marks on the plurality of ink cartridges collectively form a pattern of marks;

electronically scanning the pattern of marks; and automatically producing an indication in accordance with the pattern of marks.

2. The method of claim 1, additionally comprising the step of setting at least one printer characteristic in response to the indication produced.

3. The method of claim 2, wherein:

the step of producing an indication comprises comparing the pattern of marks with at least one predetermined pattern; and the step of setting printer characteristics comprises:

setting the printer to a first printer performance setting if the comparing step determines that the pattern of marks matches a first one of the at least one predetermined pattern; and setting the printer to a second printer performance setting if the comparing step determines that the pattern of marks does not match any of the at least one predetermined patterns.

4. The method of claim 3, wherein the step of setting the printer to a second printer performance setting comprises displaying an error message.

5. The method of claim 2, wherein the step of setting printer characteristics comprises:

comparing the pattern of marks with first and second predetermined patterns;

setting the printer to a first printer performance setting if the comparing step determines that the pattern of marks matches the first predetermined pattern; and setting the printer to a second printer performance setting if the comparing step determines that the pattern of marks matches the second predetermined pattern.

6. The method of claim 5, wherein:

the housing of each cartridge encloses an interior space containing ink;

the marks on the plurality of cartridges form the first predetermined pattern if the housings are filled with a first quantity of ink;

the marks on the plurality of cartridges form the second predetermined pattern if the housings are filled with a second quantity of ink;

the first printer performance setting includes a first expected print yield; and the second printer performance setting includes a second expected print yield.

7. The method of claim 1, wherein the housing of each cartridge encloses an interior space containing ink, and the step of producing an indication in accordance with the pattern of marks comprises displaying a predetermined message if the pattern of marks indicates the ink cartridges are inappropriate.

8. The method of claim 1, wherein the step of scanning the marks on the exterior surface of the housing comprises:

scanning a first mark on a first one of the cartridges, wherein the first mark on the first cartridge has a first predetermined characteristic;

scanning additional marks on the first cartridge and on additional cartridges.

9. A set of ink cartridges for a printer, the set of cartridges comprising a plurality of ink cartridges, each of which comprises a housing enclosing an interior space, and marks on an exterior surface of the housing, and wherein the marks on the housings of the ink cartridges are arranged so that when the cartridges are properly installed in the printer, the marks form a predetermined pattern of marks corresponding to a pattern of data stored in the printer.

10. The set of ink cartridges of claim 9, wherein the plurality of ink cartridges comprises:

a first cartridge having a reference mark and a plurality of data marks on the exterior surface of the housing; and second cartridge having a plurality of data marks on the exterior surface of the housing.

11. The set of ink cartridges of claim 10, wherein the plurality of ink cartridges additionally comprises:

a third cartridge having a plurality of data marks on the exterior surface of the housing; and a fourth cartridge having a plurality of data marks on the exterior surface of the housing.

12. The set of ink cartridges of claim 11, wherein:

the reference mark on the first cartridge comprises a bar of a first color; and the data marks on the first, second, third, and fourth cartridges comprise bars of either the first color or a second color.

13. The set of ink cartridges of claim 9, wherein the plurality of ink cartridges comprises:

a black cartridge containing black ink in the interior space of the housing, and having a reference mark and a plurality of data marks on the exterior surface of the housing;

a first color cartridge containing a first color ink in the interior space of the housing, and having a plurality of data marks on the exterior surface of the housing;

a second color cartridge containing a second color ink in the interior space of the housing, and having a plurality of data marks on the exterior surface of the housing; and a third color cartridge containing a third color ink in the interior space of the housing, and having a plurality of data marks on the exterior surface of the housing.

14. The set of ink cartridges of claim 9, wherein:

the marks form a first predetermined pattern if the interior space of the housing of each of the cartridges contains ink having a first characteristic; and the marks form a second predetermined pattern if the interior space of the housing of each of the cartridges contains ink having a second characteristic.

15. The set of ink cartridges of claim 14, wherein:

the first characteristic is being of a first predetermined brand; and the second characteristic is being of a second predetermined brand.

16. The set of ink cartridges of claim 14, wherein:

the first characteristic is being of a first predetermined ink type; and the second characteristic is being of a second predetermined ink type.

17. The set of ink cartridges of claim 14, wherein:

the first characteristic is having a first predetermined quantity in the interior space of the housing; and the second characteristic is having a second predetermined quantity in the interior space of the housing.

18. A printer for printing a multi-color ink image onto a print medium, the printer comprising:

a frame;

a media support attached to the frame for supporting the media in a print position;

a printhead for dispensing ink onto media supported in the print position;

an ink supply system connected to the printhead for supplying ink to the printhead, the ink supply system including a plurality of ink cartridges, each of which comprises a housing enclosing an interior space, and has marks on an exterior surface of the housing, and wherein the marks on the housings of the ink cartridges are arranged so that when the cartridges are properly installed in the ink supply system, the marks form a pattern of marks;

a sensor positioned to scan the marks on the cartridges installed in the ink supply system;

a controller connected to the printhead for controlling the operation of the printhead, and connected to the sensor to receive data concerning the pattern of marks, wherein the controller is programmed so that if the data concerning the pattern of marks indicates that the pattern of marks is a first predetermined pattern, the controller establishes first printing parameters for the printhead, and if the data concerning the pattern of marks indicates that the pattern of marks is a second predetermined pattern, the controller establishes second parameters for the printhead.

19. The printer of claim 18, wherein the controller is additionally programmed so that if the data concerning the pattern of marks indicates that the pattern of marks is not one of a predetermined set of patterns, the controller produces an error message.

* * * * *